US011707404B2

(12) United States Patent
Tindal

(10) Patent No.: US 11,707,404 B2
(45) Date of Patent: Jul. 25, 2023

(54) SYSTEM AND METHOD FOR FACILITATING MUTUAL PENILE STIMULATION

(71) Applicant: Samuel Lee Tindal, Seattle, WA (US)

(72) Inventor: Samuel Lee Tindal, Seattle, WA (US)

(73) Assignee: Paragate LLC, Seattle, WA (US)

( * ) Notice: Subject to any disclaimer, the term of this patent is extended or adjusted under 35 U.S.C. 154(b) by 126 days.

(21) Appl. No.: 17/067,648

(22) Filed: Oct. 10, 2020

(65) Prior Publication Data

US 2021/0128400 A1 May 6, 2021

Related U.S. Application Data

(60) Provisional application No. 63/001,096, filed on Mar. 27, 2020, provisional application No. 62/929,049, filed on Oct. 31, 2019.

(51) Int. Cl.

| | |
|---|---|
| ***A61H 19/00*** | (2006.01) |
| ***A61H 7/00*** | (2006.01) |
| ***A61H 23/02*** | (2006.01) |

(52) U.S. Cl.

CPC ..... *A61H 19/32* (2013.01); *A61H 7/004* (2013.01); *A61H 23/02* (2013.01); *A61H 2201/1652* (2013.01)

(58) Field of Classification Search

CPC ..... A61H 19/00; A61H 19/30; A61H 19/32; A61H 19/44; A61H 19/50; A61H 2201/163; A61H 2201/0157; A61H 2201/165; A61H 2201/1652; A61H 2205/087; A61H 23/00; A61H 23/02; A61H 7/008; A61H 9/0057; A61F 5/41

See application file for complete search history.

(56) References Cited

U.S. PATENT DOCUMENTS

| | | | | |
|---|---|---|---|---|
| 6,203,491 | B1 | 3/2001 | Uribe | |
| 8,157,723 | B2 | 4/2012 | Nan | |
| 10,383,788 | B2 | 8/2019 | Depow et al. | |
| 2009/0318754 | A1 | 12/2009 | Ettmer | |
| 2011/0082333 | A1* | 4/2011 | Wilson | A61H 19/44 600/38 |
| 2017/0100302 | A1* | 4/2017 | Depow | A61H 7/008 |
| 2017/0135845 | A1* | 5/2017 | Cohen | A61F 5/41 |

FOREIGN PATENT DOCUMENTS

| | | | |
|---|---|---|---|
| DE | 102010053765 | A1 | 6/2012 |
| GB | 2467913 | A | 8/2019 |

OTHER PUBLICATIONS

"AliExpress" https://www.aliexpress.com/i/1000007026761.html, "Customer reviews" dating back to Apr. 5, 2019 (Year: 2019).*

(Continued)

*Primary Examiner* — Christine H Matthews

(74) *Attorney, Agent, or Firm* — Bold IP, PLLC; Christopher Mayle

(57) ABSTRACT

A system and method for a sexual aid device having a sheath in which to dispose the penis of the first and second users and an apparatus to affix the sheath around the penis of the first user to prevent it from sliding off, a ring that may be placed around the genitals, and a garment which is attached to the sheath and/or ring and placed around the waist, legs, or other body part.

3 Claims, 17 Drawing Sheets

(56) References Cited

OTHER PUBLICATIONS

"Lovetoy" https://buylovetoy.com/products/strap-on-boxer-harness, "Questions" section dating back to Aug. 11, 2019 (Year: 2019).*
Tabooless.net, "Tom of Finland Head to Head Masturbator," https://tabooless.net/toys/couples-toys/gay/the-10-best-couples-toys-for-gay-men/ [date accessed: Nov. 13, 2019].
Indiegogo.com, "SirFrotsAlot: A Real Gay Sex Toy for Male Couples," iegogo.com/projects/sirfrotsalot-a-real-gay-sex-toy-for-male-couples-2#/ [date accessed: Nov. 13, 2019].

* cited by examiner

SYSTEM AND METHOD FOR FACILITATING MUTUAL PENILE STIMULATION

CROSS REFERENCE TO RELATED APPLICATIONS

This application is a non-provisional application which claims priority to U.S. Provisional Application No. 62/929,049 filed on Oct. 31, 2019 and U.S. Provisional Application No. 63/001,096 filed on Mar. 27, 2020, which are incorporated by reference in their entirety.

FIELD OF DISCLOSURE

The field of disclosure is generally directed to the field of sexual aid devices and more particularly to sexual aid devices which facilitates sexual stimulation via direct penis-to-penis contact.

BACKGROUND

Sex toys and other apparatuses have been gradually becoming more and more popular. Sex toys can help make sex more enjoyable, helping couples discover what turns them on. Also, great sex can promote health and wellbeing by improving your mood and physical endurance. Using a sex toy can spice up a flagging sex life and bring a bit of fun into your life. Conventional hand-held sex toys are very common but bothersome and cumbersome to use. Frequently, the user's arms and hands can get tired. Devices such as these may also be too restrictive and may be dangerous if not used properly. Thus exists a need for a new improved sex toy.

SUMMARY

The disclosure presented herein relates to a sex toy, comprising: an elongated hollow tube body with a first end with first opening and opposite second end with second opening; a ring attached to the first end of the body, a waistband attached to the tube near the second end, further comprising straps having a first end attached to the ring and an opposite end attached to the waistband, further comprising a garment with an opening through a crotch area configured to dispose the penis and/or scrotum, the garment connected to the tube, the garment having a first end positioned in contact with the opening in the garment, wherein the second opening of the tube has a protruding lip, the tube body having one or more vibrating motors, the tube body having one or more suction devices.

The disclosure presented herein also relates to a sex toy comprising: a y-shaped outer body with a first branch with a first opening and one or more second branches extending at angle from the first branch, the one or more second branches having one or more second openings, having an inner surface with a soft-flesh-like-material, further comprising, a ring attached to a first end of the first branch, further comprising a garment with an opening through a crotch area configured to dispose the penis and/or scrotum, the garment connected to the tube, the garment having a first end positioned in contact with the opening in the garment, the tube body having one or more vibrating motors, the tube body having one or more suction devices.

The disclosure presented herein also relates to a sex toy comprising: an elongated hollow tube body with a first end with first opening and opposite second end with second opening; a ring attached to the first end of the body, the tube body having one or more motors, the sex toy having a communication system configured to connect to one or more computing devices, wherein the motors are controllable by the computing device, further comprising one or more individual compartments wherein each of the individual compartments are separately controlled by the one or more motors, further comprising a garment with an opening through a crotch area configured to dispose the penis and/or scrotum, the garment connected to the tube, the garment having a first end positioned in contact with the opening in the garment, the tube body having one or more suction devices wherein the suction devices are controllable by the computing device.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
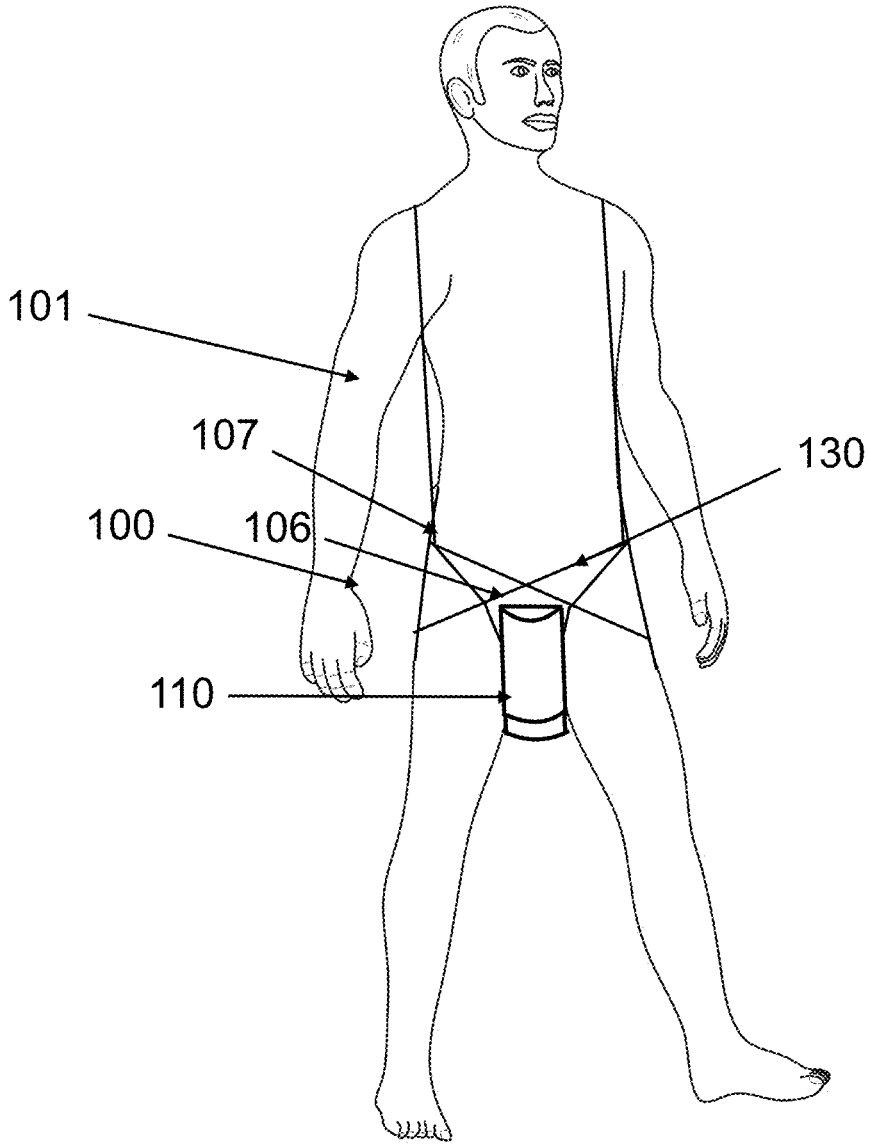
FIG. 1 illustrates a front view of person using a device which includes a sheath with a single opening at the bottom of the body, single inner chamber and a base garment which resembles boxer briefs.
Figure 2:
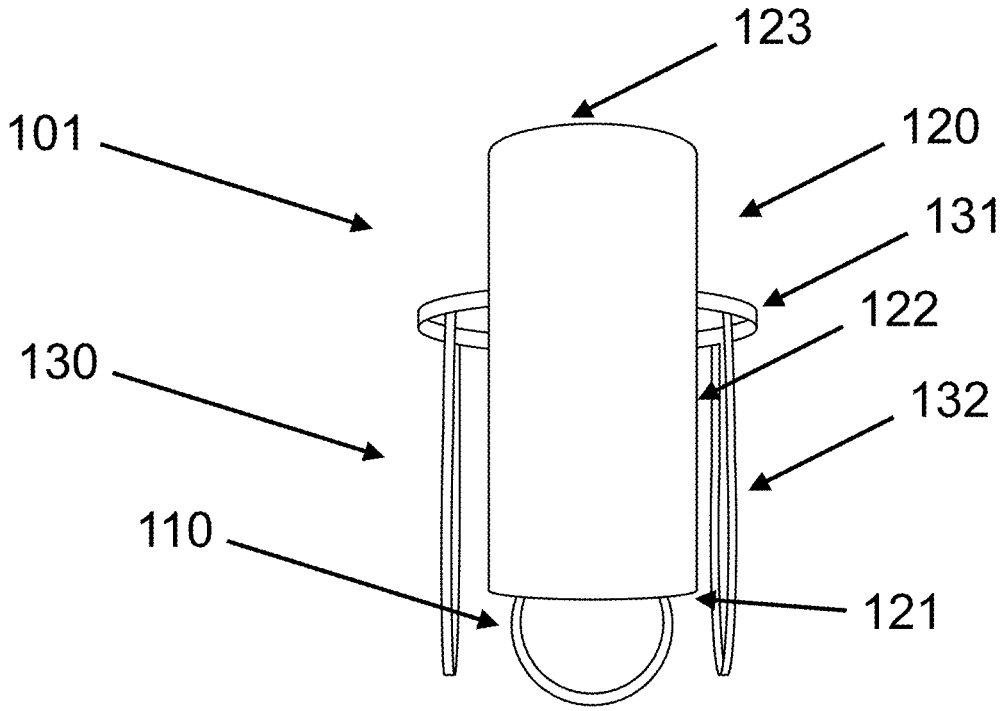
FIG. 2 illustrates a view of the device which includes a sheath with one opening at the bottom of the body, a ring, connected to a garment which consists of a waist band and thigh straps.
Figure 3:
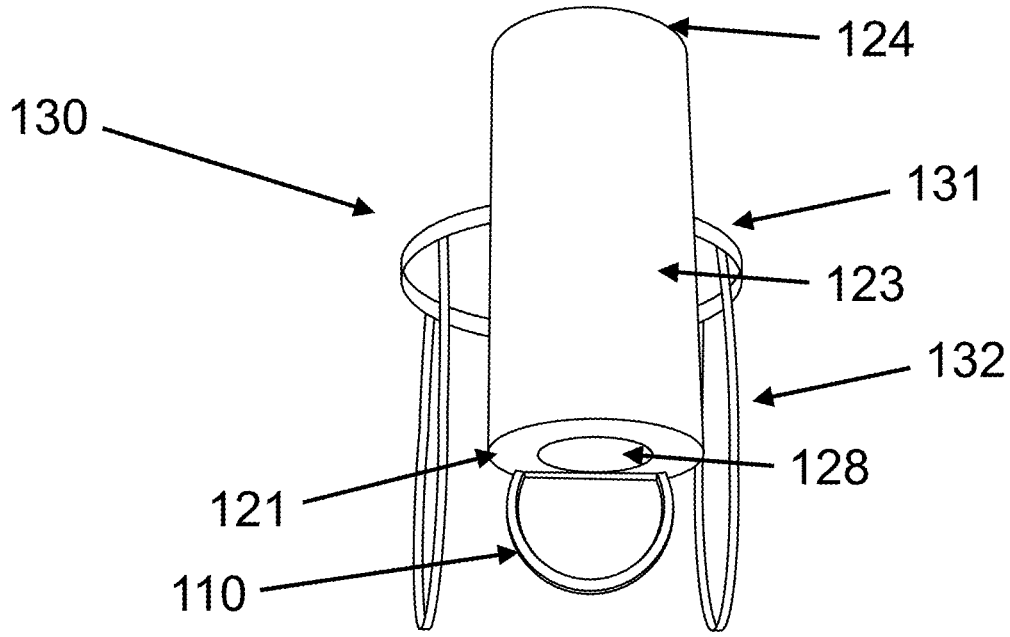
FIG. 3 illustrates another view of FIG. 2.
Figure 4:
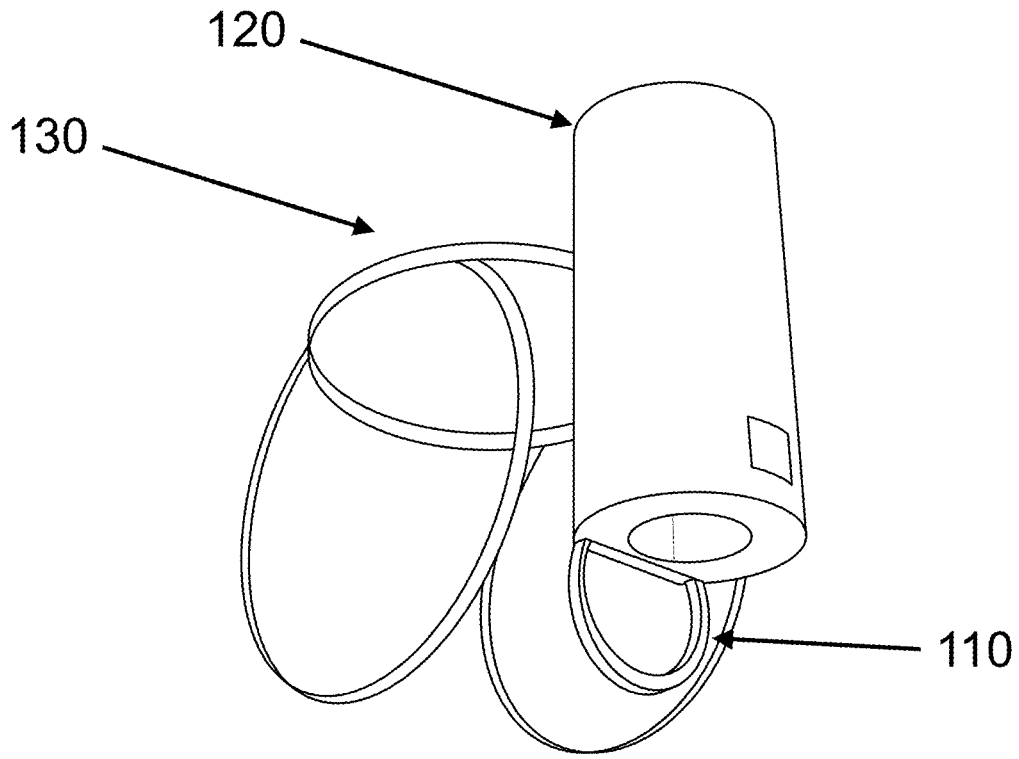
FIG. 4 illustrates another view of FIG. 2.
Figure 5:
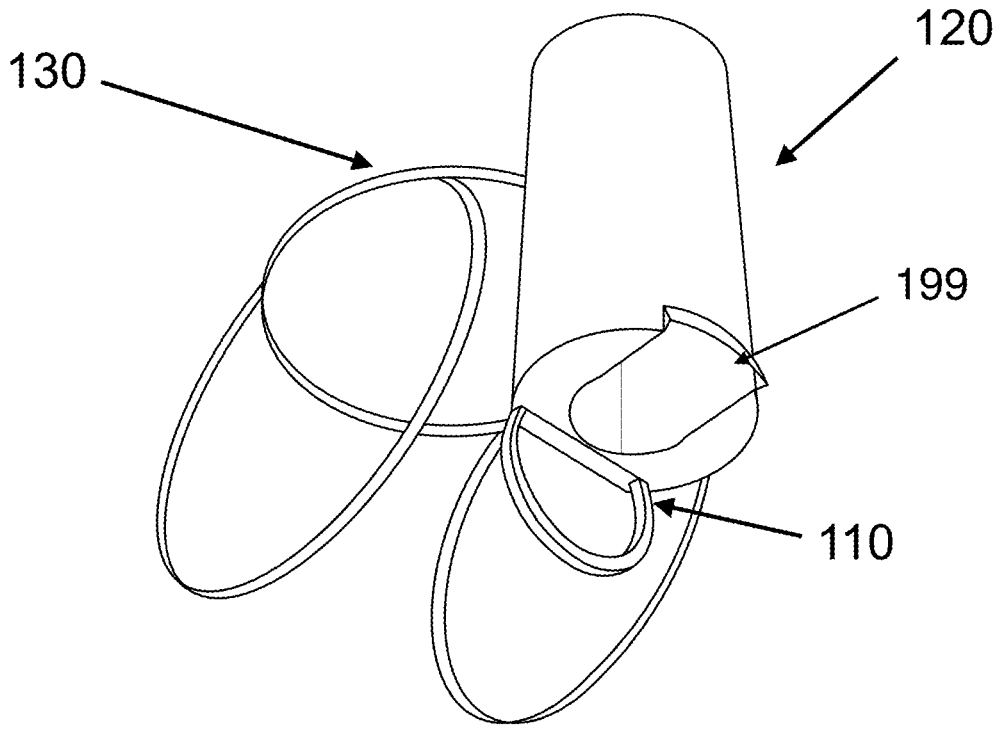
FIG. 5 illustrates another view of FIG. 2.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined).

"Exemplary" is used herein to mean "serving as an example, instance, or illustration." Any aspect described in this document as "exemplary" is not necessarily to be construed as preferred or advantageous over other aspects Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure is generally drawn to a system and method, according to one or more exemplary embodiments, for a sexual aid device. The sexual aid device may have a sheath in which to dispose the penis of the first and second users and an apparatus to affix the sheath around the penis of the first user to prevent it from sliding off. The options for affixing the sheath to the penis include a ring attached to the base of the sheath. The ring may be placed around the genitals and/or a base garment which are attached to the sheath and/or ring and placed around the waist, legs, or other body part. The sexual aid device may also provide suction or vibration to the sheath body or ring through motors and suction mechanisms. The sexual aid device may also be connected to one or more computing devices for further personalization for the users.

With reference now to FIG. 1, one exemplary embodiment of sexual aid device 100 is generally designated. Sexual aid device 100 may have a ring 110, sheath 120, and garment 130. Sexual aid device 100 may be stored or transported in a cover or case to be inserted in to prevent lubrication from spreading and from which it can be removed for cleaning. The case may also be integral in the sheath and or other parts of sexual aid device 100. The entire case may be shaped like another object such as a soda can for discrete storage.

As illustrated in FIGS. 2-5, Sheath 120 may have a cylindrical body with a bottom surface portion 121 with an aperture 128 therethrough the center of bottom surface portion 121. A sidewall portion 122 extends upward from an upper margin of bottom surface portion 121. Sidewall portion 122 then extends upward into a closed top surface portion 123. Sheath 120 may be of any length or circumference to accommodate for differences in penis length and girth between various users.

Figure 13:
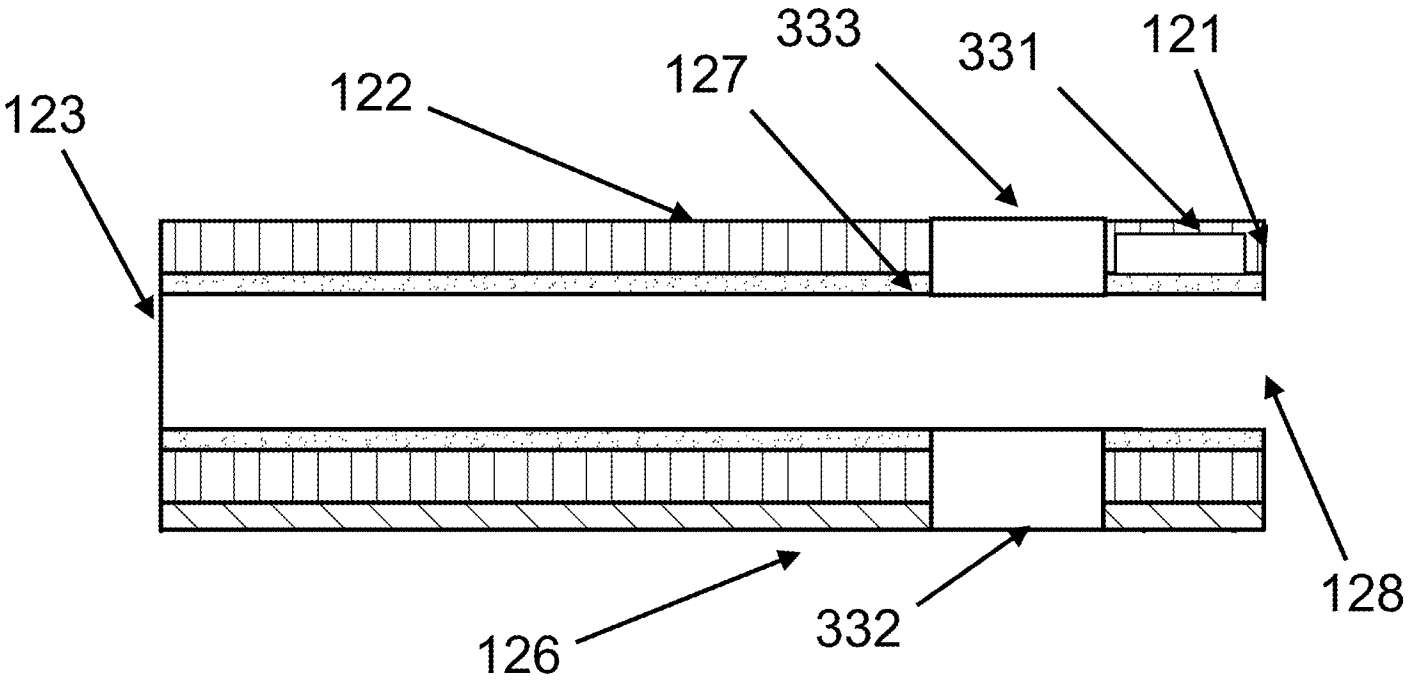
FIG. 13 illustrates a broken view of one embodiment of the device.
Figure 14:
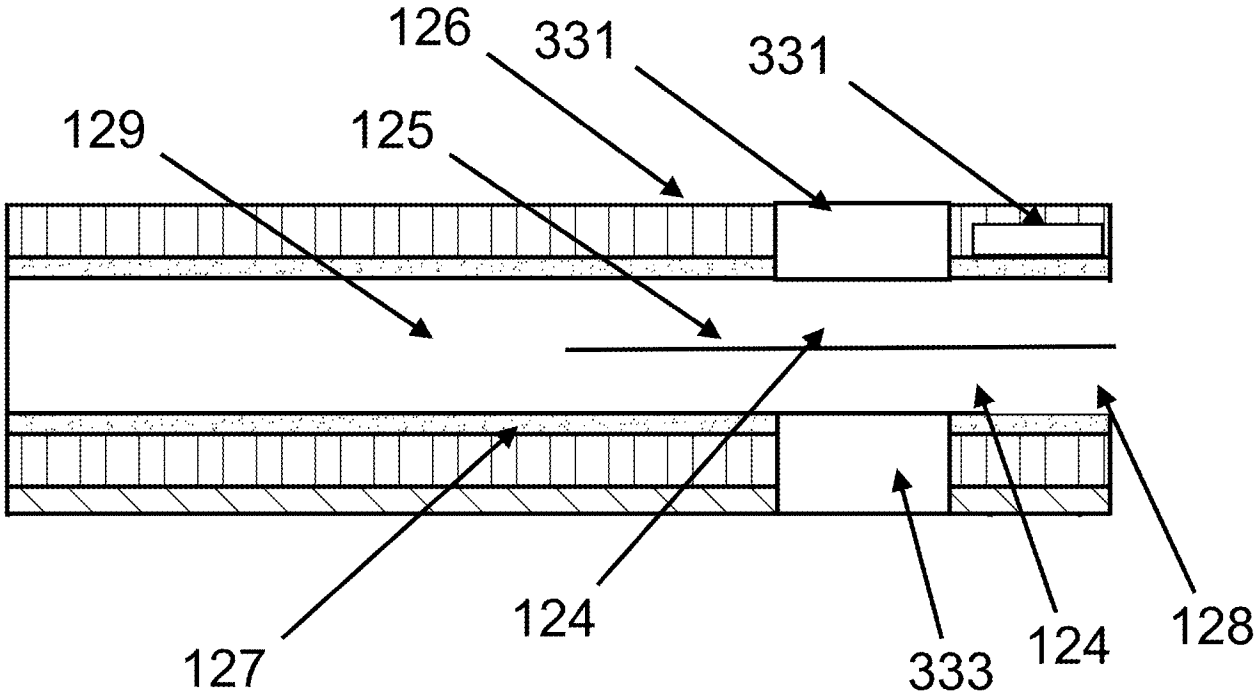
FIG. 14 illustrates a broken view of another embodiment of the device.
Figure 15:
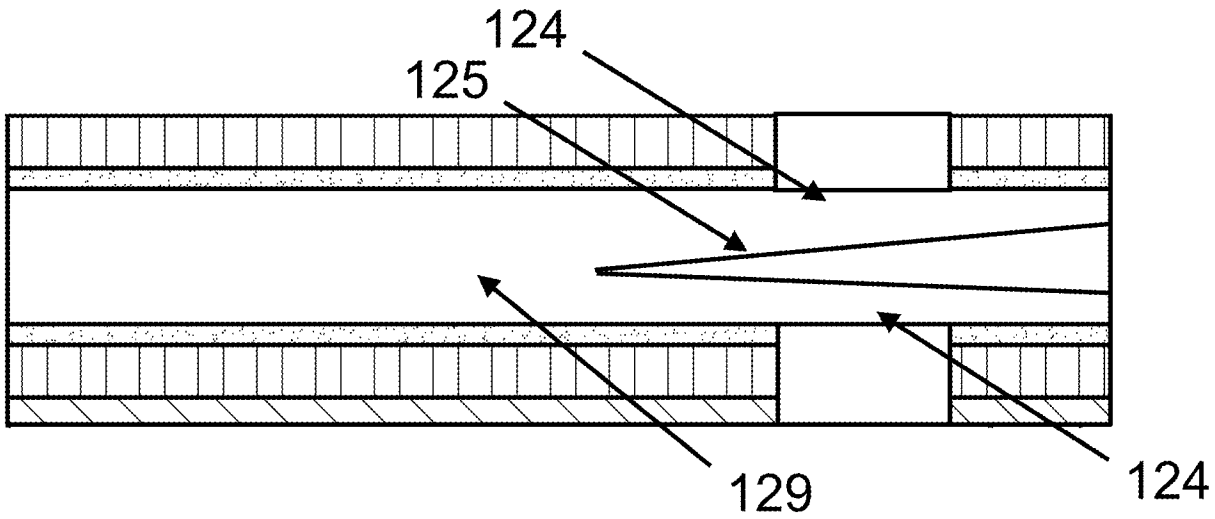
FIG. 15 illustrates a broken view of another embodiment of the device.

Sheath 120 may have an outer surface 126 and inner surface 127 defining an inner cavity as illustrated in FIG. 13. Outer surface 126 may be of any shape or texture such as a rigid material. Inner surface 127 may be made of suitable elastomeric gel material. In some embodiments as illustrated in FIG. 14, the inner cavity may have one or more partitions 125, extending along a length of sidewall portion 122, which separate the inner cavity into at least two segregated individual compartments 124 that are adjacent to one another. Individual compartments 124 may act as receiving elements for an individual penis whereby the individual penises may enter into individual compartments 124 through the aperture in the bottom surface 121. When partitions 125 end or merge, a convergence compartment 129 is created such that at least a portion of the user's penises will be in direct contact in the convergence compartment 129.

Figure 24:
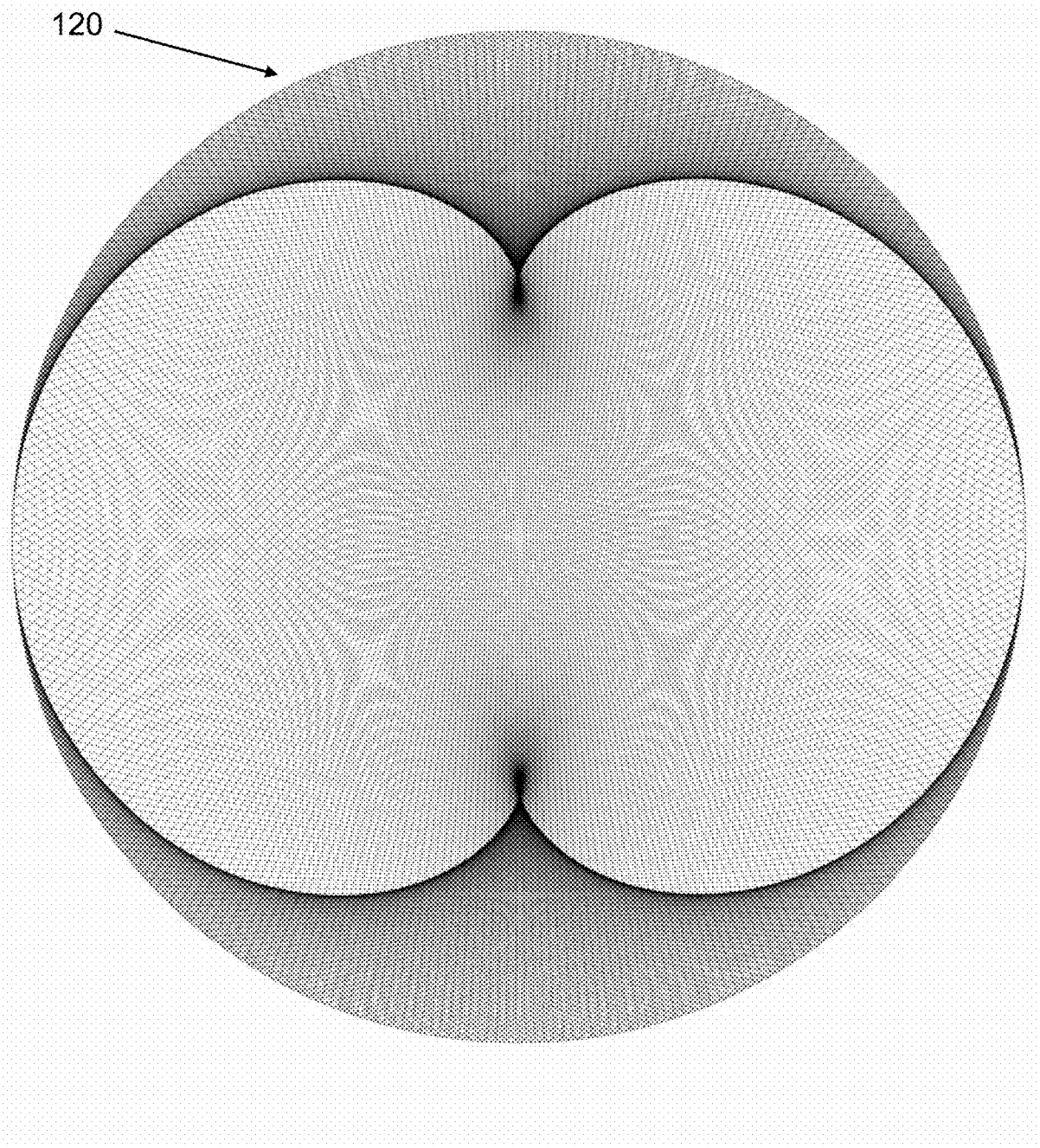
FIG. 24 illustrates an interior view of an embodiment having a cardiod shape

Partitions 125 may be in the form of a vertical or horizontal partition 125, such that individual compartments 124 may be symmetrical to one another with respect to vertical or horizontal axis of the sheath 120 until reaching convergence compartment 129. Partitions 125 may be in the form of diagonal partitions directing inward into the center of the inner chamber of sheath 120 as illustrated in FIG. 14. Partitions 125 may be in the form of a cardioid shape with mirroring mushroom shaped compartments facing inward into the center of the inner chamber of sheath 120 as illustrated in FIG. 24. This is non-limiting and partitions 125 may be positioned in any arrangement, pattern, or configuration. Sidewall portion 122 may have a threaded portion or ribbed portion along inner wall 127 allowing for further pleasuring of the penis inside of compartments 12.

Sheath 120 may be made of any material or combination of materials such as but not limited to silicon, flexible plastics, latex, etc. Sheath 120 may be manufactured using but not limited to methods including RTV molding, 3D printing, HCR, LSR, weaving, carving, injection molding, rotational molding, extrusion blow molding, reaction injection molding, vacuum casting, thermoforming, compression molding, or any combination of the aforementioned methods. In other embodiments, sheath 120 may be any other shape as desired, such as a cube or other shaped prism.

Figure 6:
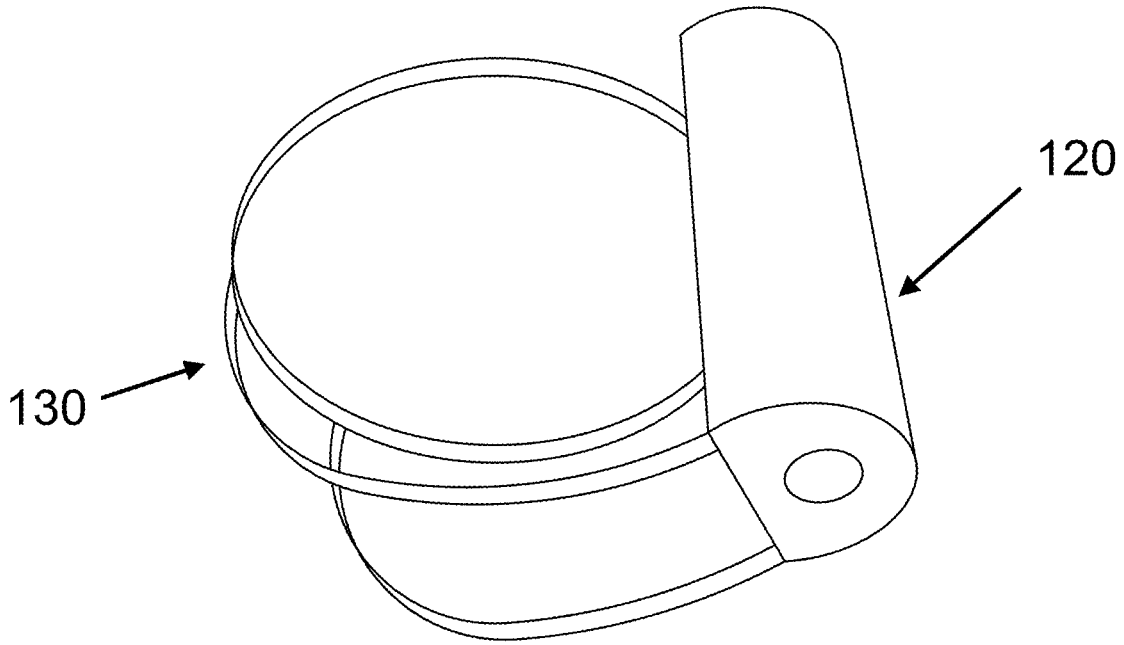
FIG. 6 illustrates another view of FIG. 2 without the ring.
Figure 7:
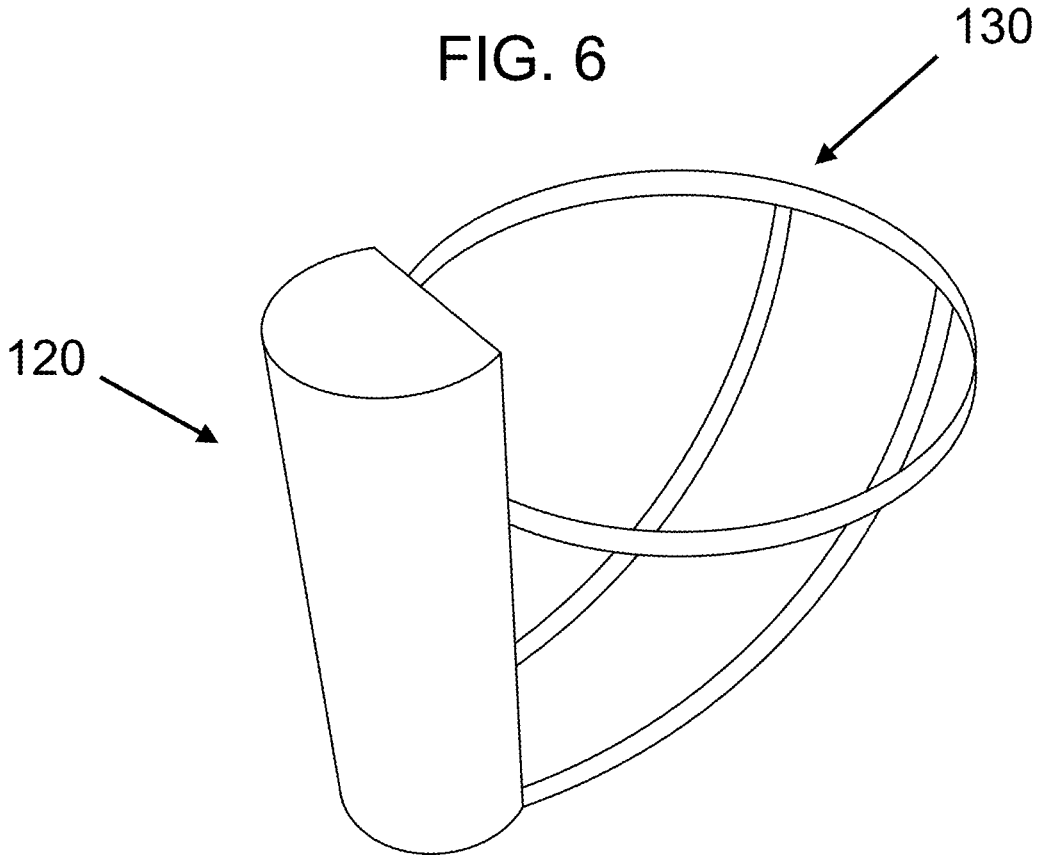
FIG. 7 illustrates another view of FIG. 6.
Figure 8:
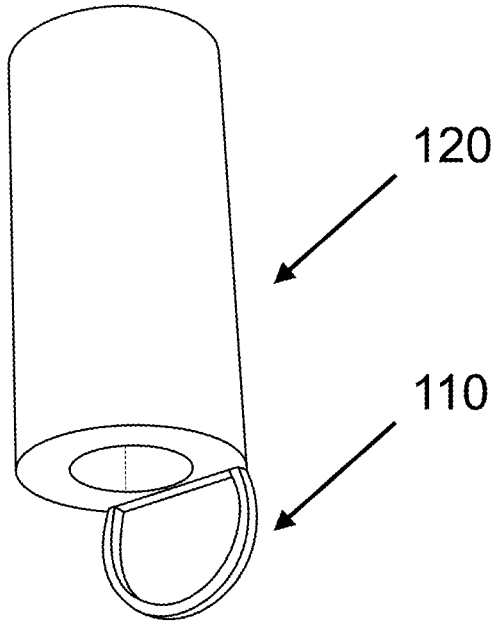
FIG. 8 illustrates a view of the device of FIG. 2.

Sheath 120 may be connected to ring 110 whereby ring 110 extends downward from bottom portion 121 as illustrated in FIGS. 2-5. A pivotable hinge may be provided on bottom portion 121 whereby ring 110 is pivotably connected to sheath 120 via the hinge such that ring 110 may be orientated at an angle with respect to the sheath 120 including a right angle, obtuse angle, or acute angle. Ring 110 is designed so that a user may initially place their penis and scrotum first through ring 110 and then through one of the individual compartments 124 in sheath 120. The scrotum of the user should then be pulled through ring 110. In this position, ring 110 should limit sheath's 120 movement superiorly along the median plane when placed around the scrotum. In other non-limiting embodiments, sexual aid device 100 may not have a ring 110 and instead the user directly inserts their penis into individual compartments 124 as shown in FIGS. 6 and 7.

Sheath 120 and ring 110 may be connected or otherwise integrated into a garment 130. In other embodiments, garment 130 may be attached to or integrated with just sheath 120 or ring 110. Garment 130 may be placed around the waist (waistband), legs, shoulders or other body parts so that the user can dispose themselves into sexual aid device 100 like putting on a jockstrap, harness or suspenders.

Figure 9:
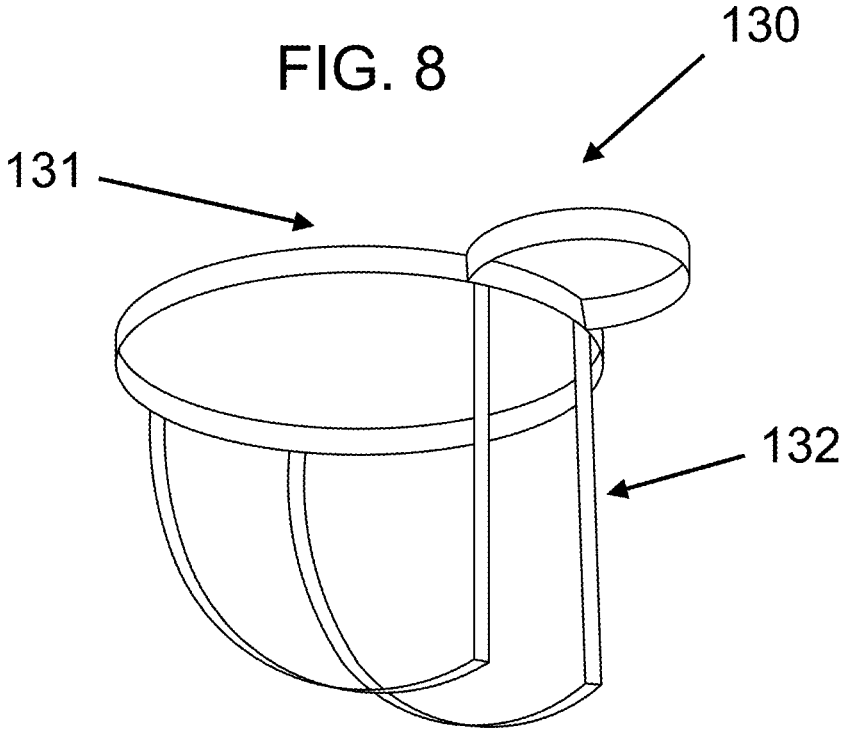
FIG. 9 illustrates a view of the garment of FIG. 2.
Figure 10:
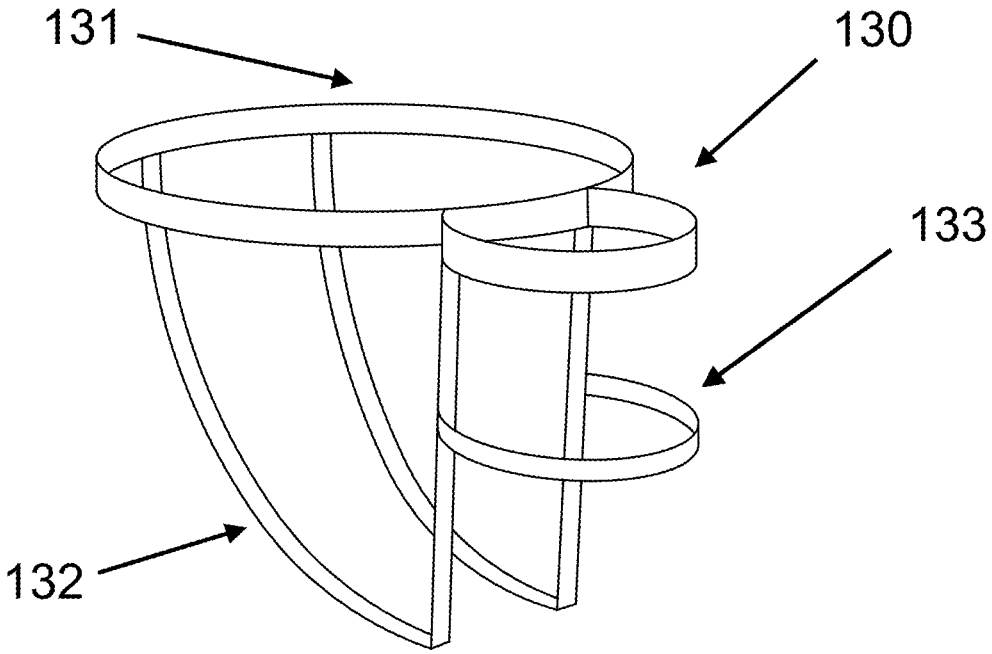
FIG. 10 illustrates another view of the garment in FIG. 9.

Garment 130, as illustrated in FIG. 1 may be comprised of an article of underwear 106 with a plurality of straps 107 that fit over the waist of user 101 as well as the shoulders. Straps 107 may be connected to sheath 120 with one or more fasteners 130, as illustrated in FIG. 9-10, may be comprised of a waistband 131 and straps 132 attached to bottom surface portion 121 or sidewall portion 122 extending backward and upward to the sides of the waistband 131. Waistband 131 and straps 132 may be connected to a receptable 133 with one or more loops acting as a housing for sheath 120. Waistband 131 and straps 132 may be made of any width and length or of any material as may be found necessary to render the same most comfortable for the user. Waistband 131 and straps 132 may have one or more elastic bands of resilient material selected according to their modulus of elasticity to tightly engage each of the lines of dependency such that garment 130 will remain firmly engaged against the user.

In one or more non-limiting embodiments, garment 130 may also include fasteners using buckles, clasps or other fastening mechanisms which allow them to be adjustable to fit a wide range of body types.

Figure 11:
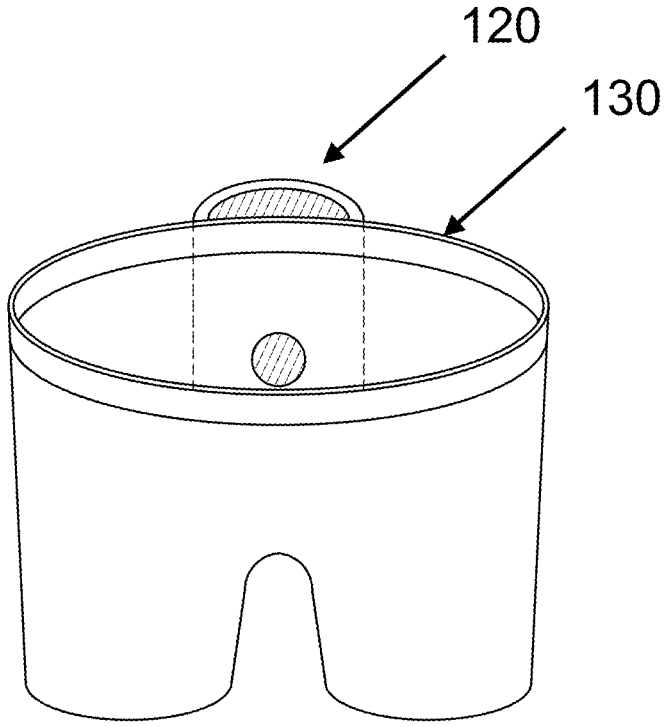
FIG. 11 illustrates another view of FIG. 1.
Figure 12:
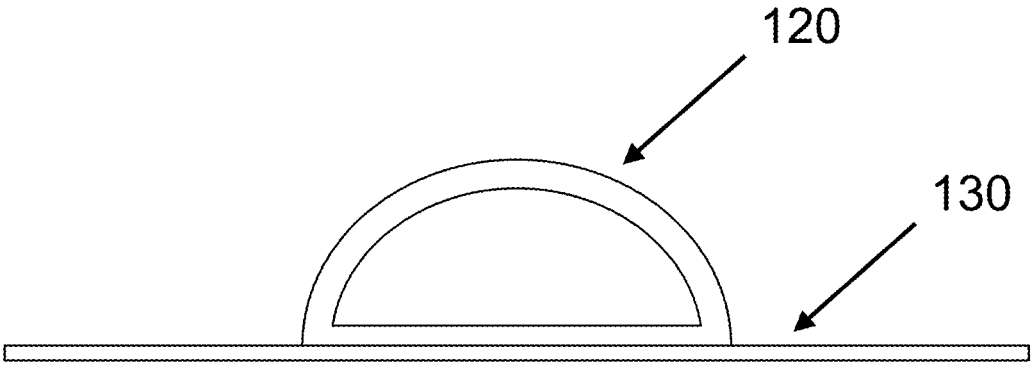
FIG. 12 illustrates a top view of FIG. 1.

In some non-limiting embodiments, garment 130 may resemble traditional men's briefs as shown in FIGS. 11 and 12. Waistband 131 may extend downward into a front pouch with an aperture therethrough the front pouch to allow the user to enter their penis and/or scrotum through the aperture. Garment 130 may also include a flap which is integrated, partially integrated, or removable from garment 130 which may be used to cover the holes exposing the penis and scrotum or other body parts. In other non-limiting embodiments, garment 130 may be a combination or variation of a full-body suit, leotard, jockstrap, or thong.

A method of use would begin with the user disposing themselves into garment 130 in the method normally used for positioning clothes upon themselves. For example, in the case of garment 130 resembling a jockstrap, the user would step into holes formed between straps and pull it up around their waist. The user may then dispose their penis and scrotum through the opening or hole in the garment and dispose their scrotum through ring 110 and then dispose their penis into sheath 120. The second user would insert their penis into sheath 120 to come into contact with the penis of the first user.

Figure 16:
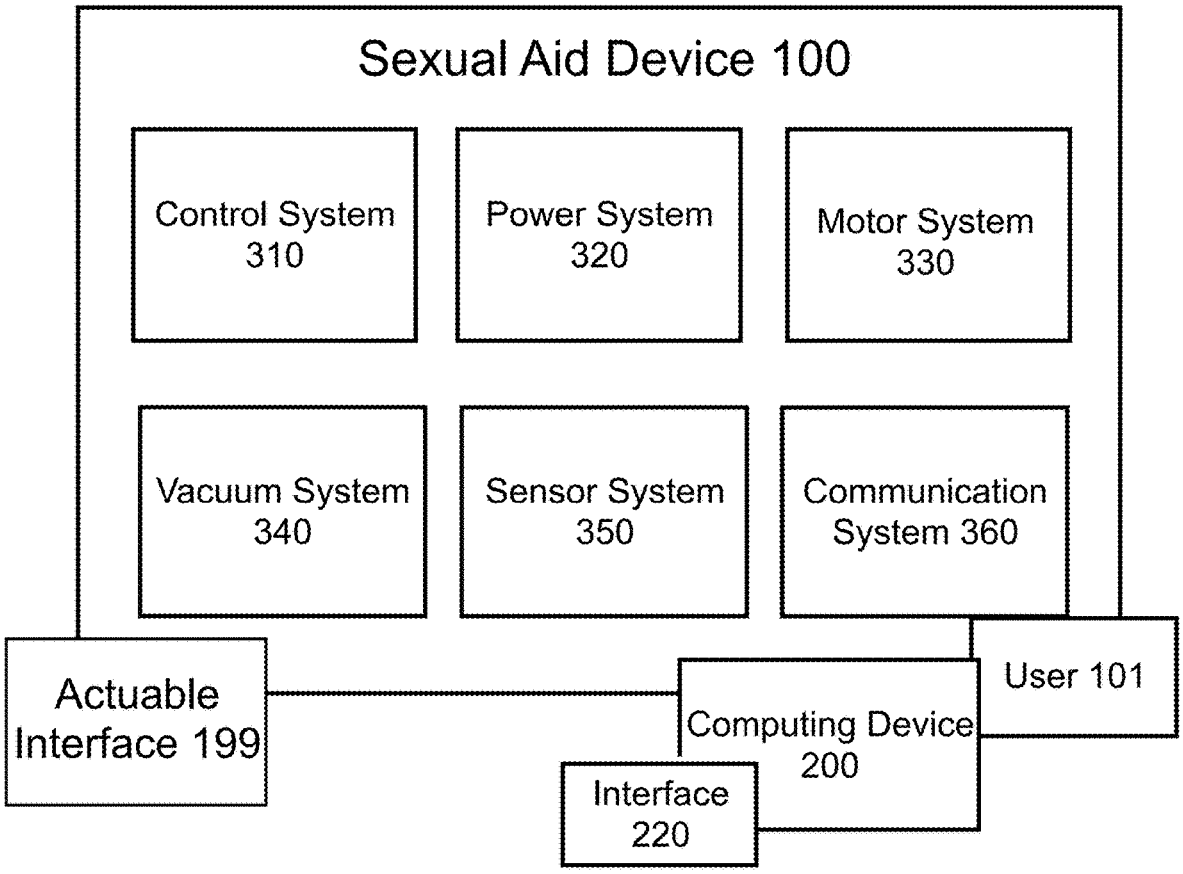
FIG. 16 is a block diagram of the components of the device

As illustrated in FIG. 16, Sexual aid device 100 may have a power system 320 designed to provide energy to the circuits and components of sexual aid device 100 during the process of operating Sexual aid device 100. Sexual aid device 100 may be powered by methods known by those of ordinary skill in the art. In some embodiments, sexual aid device 100 may plug into an electrical outlet using an electrical cord to supply power to the circuits and components of Sexual aid device 100. Further, the power system 320 may include a rechargeable battery pack whereby the rechargeable battery is of a charge, design, and capacity, to provide sufficient power to the circuits and components of Sexual aid device 100 during operation for a set period of time needed to interact with sexual aid device 100.

Sexual aid device 100 may have a control system 310 to control the actuation of the other systems. Control system 310 may have a series of computing devices which will be discussed in detail later in the description. Control system 310 may be in the form of, a circuit board, a memory or other non-transient storage medium in which computer-readable coded instructions are stored and one or more processors configured to execute the instructions stored in the memory. Control system 310 may have a wireless transmitter, a wireless receiver, and a related computer process executing on the processors.

Computing devices of control system 310, may be any type of computing device that typically operate under the control of one or more operating systems, which control scheduling of tasks and access to system resources. Computing devices may be a Raspberry Pi® or other computing devices such as but not limited to a phone, tablet, television, desktop computer, laptop computer, gaming system, wearable device electronic glasses, networked router, networked switch, networked, bridge, or any computing device capable of executing instructions with sufficient processor power and memory capacity to perform operations of control system 310.

The one or more computing devices may be integrated into control system 310, while in other non-limiting embodiments, control system 310 may be a remotely located computing device or server configured to communicate with one or more other control systems. Control system 310 may also include an internet connection, network connection, and/or other wired or wireless means of communication (e.g., LAN, etc.) to interact with other components. The connection allows a user, such as user 101, to update, control, send/retrieve information, monitor or otherwise interact passively or actively with control system 310.

Control system 310 may include control circuitry and one or more microprocessors or controllers acting as a servo control mechanism capable of receiving input from sensor system 350 and communication system 360, analyzing the input from sensor system 350 and communication system 360, and generating an output signal to motor system 330, vacuum system 340, communication system 360, and power system 320. The microprocessors (not shown) may have on-board memory to control the power that is applied to motor system 330, vacuum system 340, communication system 360, and power system 310, in response to input signals from user and from sensor system 350.

Control system 310 may include circuitry to provide an actuable interface 199 for user 101 to interact with, including switches and indicators and accompanying circuitry for an electronic control panel or mechanical control panel. Such an actuable interface 199 may present options to user 101 to select from what would allow user 101 to control motor system 330 and vacuum system 340. Control system 310 may be preprogrammed with any reference values by any combination of hardwiring, software, and firmware to implement various operational modes.

The microprocessors in control system 310 may also monitor the current state of circuitry within control system 310 to determine the specific mode of operation chosen by the user. For instance, when "on," the microprocessors may begin vacuuming or providing vibration to sexual aid device 100. Further, such microprocessors that may be part of control system 310 may receive signals from any of or all systems, including without limitation, motor system 330, vacuum system 340, communication system 360, and power system 320. Such systems may be notified whether any of the components in the various systems need to be replaced, as well as when the targeted individual compartment.

Sensor system 350 may include a plurality of detectors mounted or otherwise connected to the motor system 330, vacuum system 340, and control system 310. Control system 310 may analyze received input values from sensor system 350 and evaluate the input data setting to determine the necessary actions needed.

Motor system 330 may have one or more motors 331 positioned between inner surface 127 and outer surface 126 of sheath 120 to drive one or more rotary elements. Elements between inner surface 127 and outer surface 126 may be rotatably engaged by a rotary element. Rotation of elements cause torsion on individual compartments 124, thereby reducing the cross section of individual compartments 124 and increasing pressure applied to a penis inserted therein.

Motor system 330 may have one or more vibrating motors 332 embedded permanently or removably in the material of sheath 120. Motor system 330 may be controlled by the user which provides various settings for vibration intensity and/or rhythmic vibration.

Vacuum system 340 may have a suction component 333 including an accumulator which creates a vacuum in sheath 120 which may be connected to the sheath body via a tube, integrated into sheath 120 near top surface component 123 or between inner surface 127 and outer surface 126, or connected in an air-tight or nearly air-tight manner. The accumulator may be connected to power system 320. The accumulator may also be connected to or integrated with a device which adjusts the suction intensity and/or rhythm of the suction and release of suction.

Control system 310 may be in communication with communication system 360 to connect with one or more computing devices whereby signals transmitted from the computing devices may be received by control system 310 to allow user 101 to interact with sexual aid device 100 using computing device 200. In one or more non-limiting embodiments, communication system 360 may be innate, built into, or otherwise integrated into existing platforms or systems such as a website, a third party program, Apple™ operating systems (e.g. iOS), Android™ Snapchat™, Instagram™, Facebook™, or any other platform. User 101 may access communication interface 220 using computing device 200. Communication interface 220 may have a plurality of buttons or icons that are selectable by user 101 for communication system 360 to perform particular processes in response to the selections.

Figure 17:
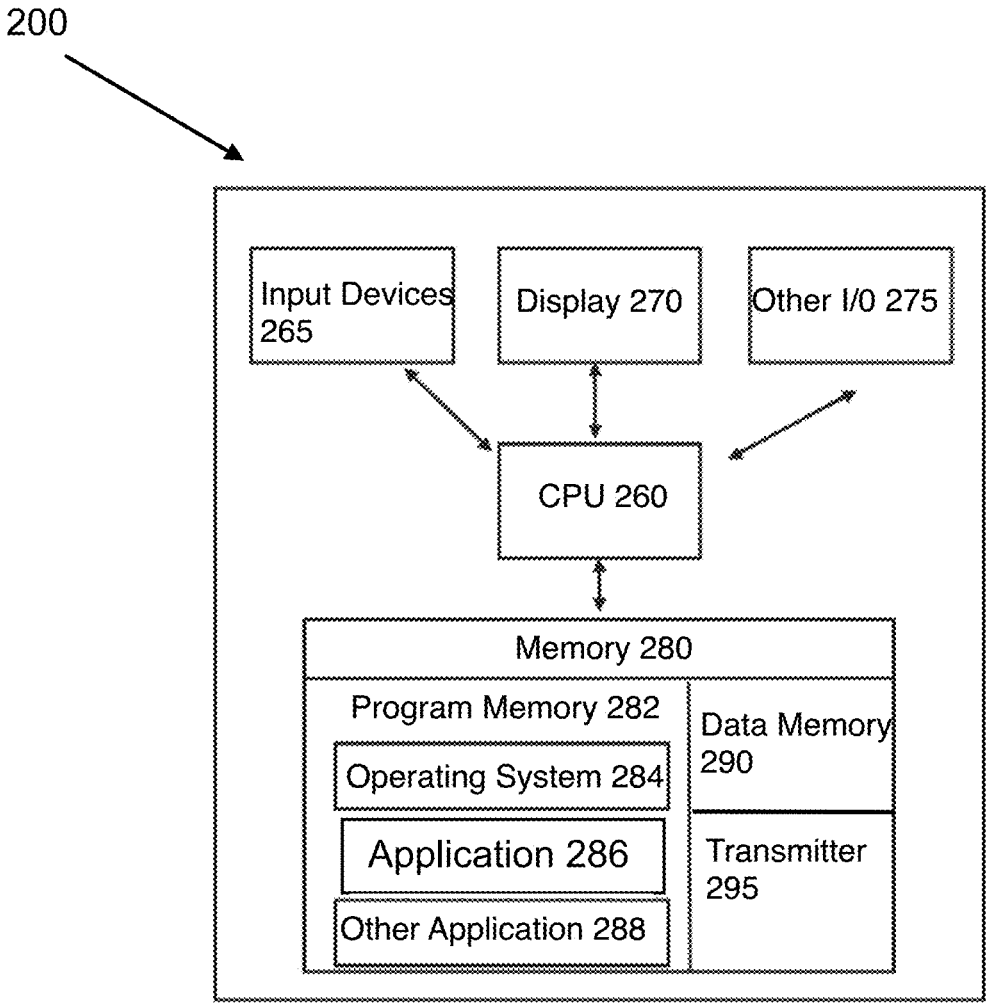
FIG. 17 is a block diagram of a computing device.

Turning to FIG. 17, FIG. 17 is a block diagram showing various components of computing device 200. Computing device 200 may comprise a housing for containing one or more hardware components. Computing device 200 may include one or more input devices such as input devices 265 that provide input to a CPU (processor) such as CPU 260 of actions related to user 101. Input devices 265 may be implemented as a keyboard, a touchscreen, a mouse, via voice activation, wearable input device, a 3D camera, a trackball, a microphone, a fingerprint reader, an infrared port, a controller, a remote control, a fax machine, and combinations thereof.

The actions may be initiated by a hardware controller that interprets the signals received from input device 265 and communicates the information to CPU 260 using a communication protocol. CPU 260 may be a single processing unit or multiple processing units in a device or distributed across multiple devices. CPU 260 may be coupled to other hardware devices, such as one or more memory devices with the use of a bus, such as a PCI bus or SCSI bus. CPU 260 may communicate with a hardware controller for devices, such as for a display 270. Display 270 may be used to display text and graphics. In some examples, display 270 provides graphical and textual visual feedback to a user.

In one or more embodiments, display 270 may include an input device 265 as part of display 270, such as when input device 265 is a touchscreen or is equipped with an eye direction monitoring system. In some implementations, display 270 is separate from input device 265. Examples of display 270 include but are not limited to: an LCD display screen or an LED.

Other I/O devices such as I/O devices 275 may also be coupled to the processor, such as a network card, video card, audio card, USB, FireWire or other external device, camera, printer, speakers, CD-ROM drive, DVD drive, disk drive, or Blu-Ray device. In further non-limiting embodiments, a display may be used as an output device, such as, but not limited to, a computer monitor, a speaker, a television, a smart phone, a fax machine, a printer, or combinations thereof.

CPU 260 may have access to a memory such as memory 280. Memory 280 may include one or more of various hardware devices for volatile and non-volatile storage and may include both read-only and writable memory. For example, memory 280 may comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. Memory 280 may be a non-transitory memory.

Memory 280 may include program memory such as program memory 282 capable of storing programs and software, including an operating system, such as operating system 284. Memory 280 may further include an application programing interface (API), such as API 286, and other computerized programs or application programs such as application programs 288. Memory 280 may also include data memory such as data memory 290 that may include database query results, configuration data, settings, user options, user preferences, or other types of data, which may be provided to program memory 282 or any element of user computing device 120.

Computing device 200 may have a transmitter, such as transmitter 295, to transmit biological data. Transmitter 295 may have a wired or wireless connection and may comprise a multi-band cellular transmitter to connect to the server over 2G/3G/4G/5G cellular networks. Other embodiments may also utilize Near Field Communication (NFC), Bluetooth, or another method to communicate information.

Communication interface 220 on computing device 200 may display statuses for sexual aid devices 100 that are registered or otherwise communicate with control system 310. Accordingly, one or more individual compartments 124 of sexual aid devices 100, each of which may be separately controllable on a user's 101 computing device 200. Communication interface 220 may display information to user 101 logged into an account that includes two individual compartments 124 for the corresponding first user and second user.

For instance, motors or accumulators of sexual aid device 100 may be selectively actuated by a signal communicated to sexual aid device to provide corresponding feedback to parts of sexual aid device 100 (e.g., provide vibration feedback for an individual compartment 124 of sexual aid device 110). For example, all actuators may provide a constant force (i.e. pure contracture), rhythmically altering force, or a force altering in sequence of waves along inner surface 127 to provide a low or high frequency localized vibration, which may remain in one location or multiple locations.

Communication interface 220 may display information to user 101 logged into an account that includes two individual compartment 124 for the corresponding first user and second user. Communication interface 220 may have an adjustable timer component for each individual compartment 124 to operate, whereby the timer component may enable input from user 101 for control system 310 to delay state changes when operating.

In other embodiments, control system 310 may have an energy saver mode, whereby communication interface 220 may allow user 101 to switch control system 310 to an off or hibernation state. Further, control system 310 may automatically turn off or enter a hibernation state at a particular time of day or after an elapsed amount of time based on predefined parameters.

Figure 18:
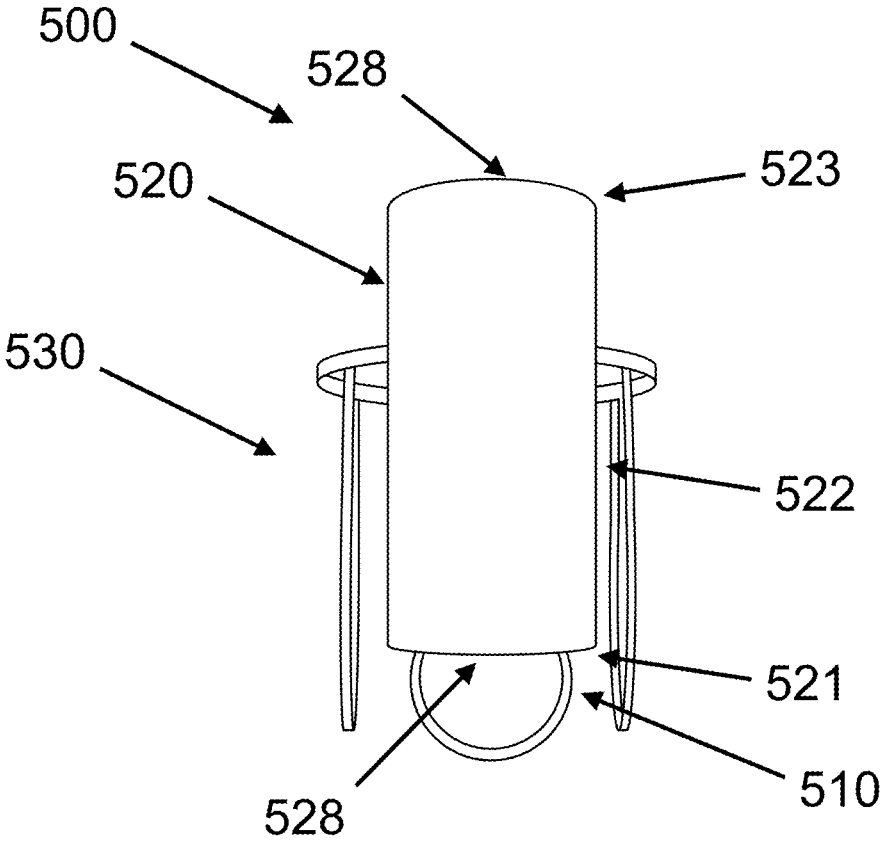
FIG. 18 illustrates a view of a second device which includes a sheath with an opening through the sheath, a ring, connected to a garment which consists of a waist band and thigh straps.
Figure 19:
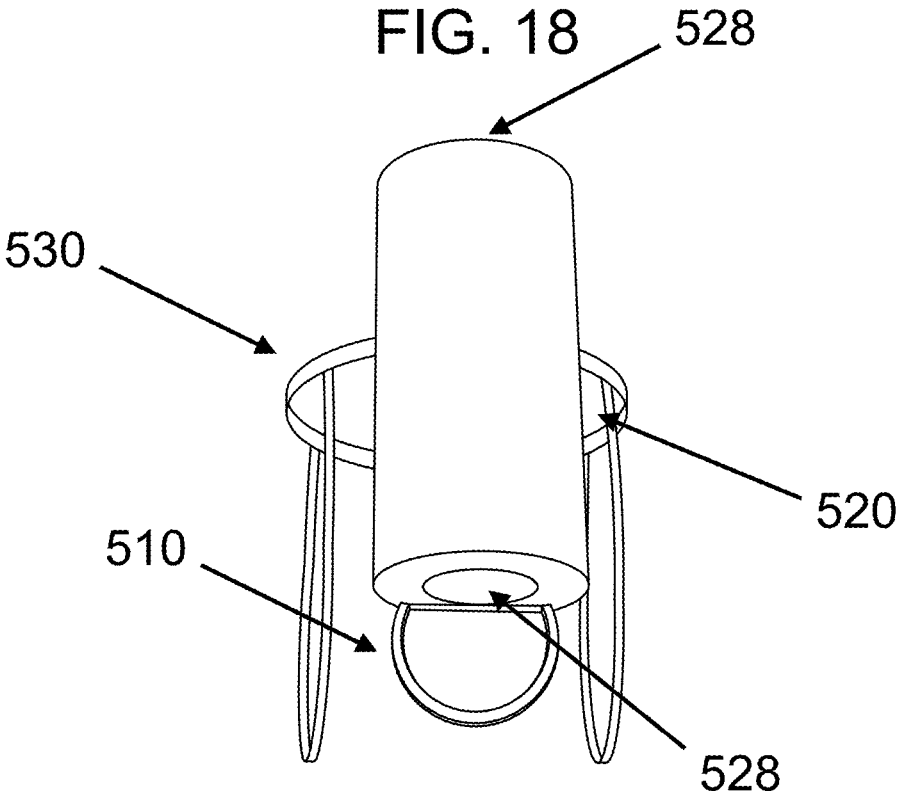
FIG. 19 illustrates another view of FIG. 18.
Figure 20:
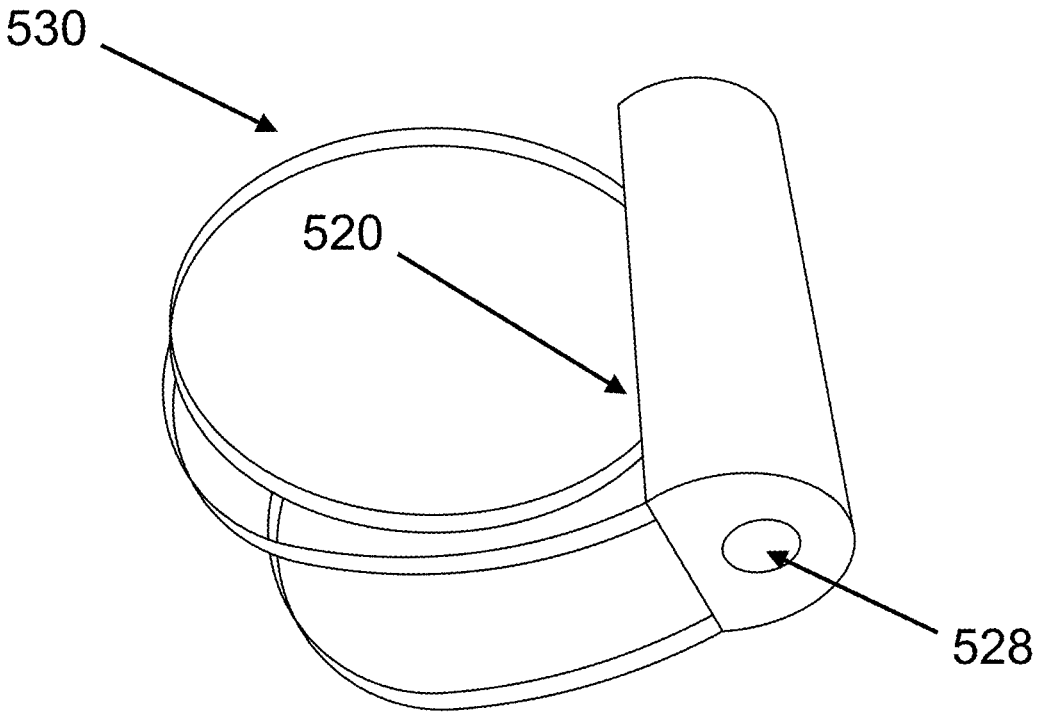
FIG. 20 illustrates another view of FIG. 18 without the ring.
Figure 21:
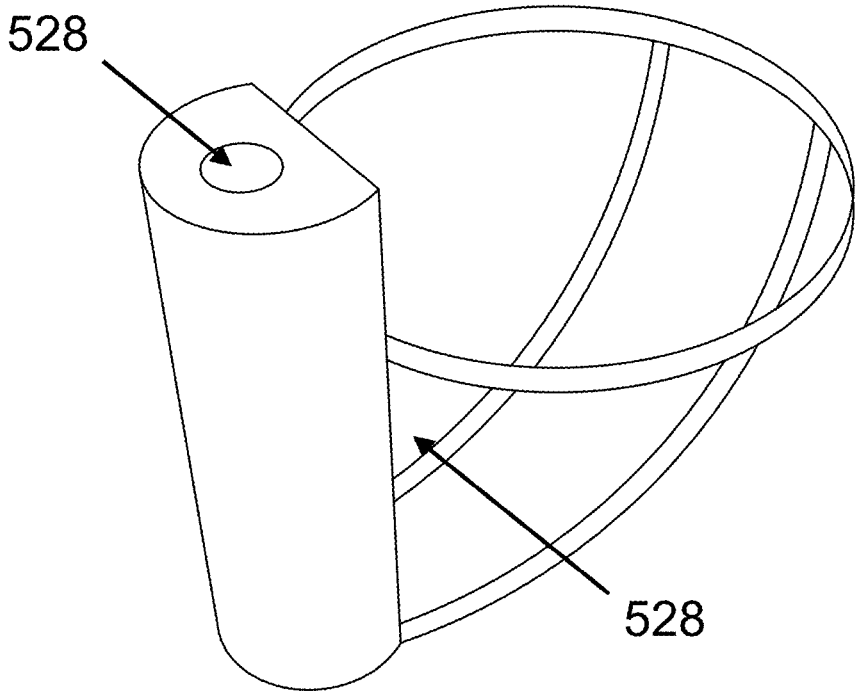
FIG. 21 illustrates another view of FIG. 20.

With reference now to FIGS. 18 and 19, another embodiment of sexual aid device 500 is generally designated. Sexual aid device 500 may have a ring 510, sheath 520, and garment 530 similar to sexual aid device 100. Sheath 520 may have a cylindrical body with a bottom surface portion 521 with an aperture therethrough the center of bottom surface portion 521. A sidewall portion 522 extends upward from an upper margin of bottom surface portion 521. Sidewall portion 522 then extends upward into a top surface portion 523 that is symmetrical to bottom portion 521.

Figure 22:
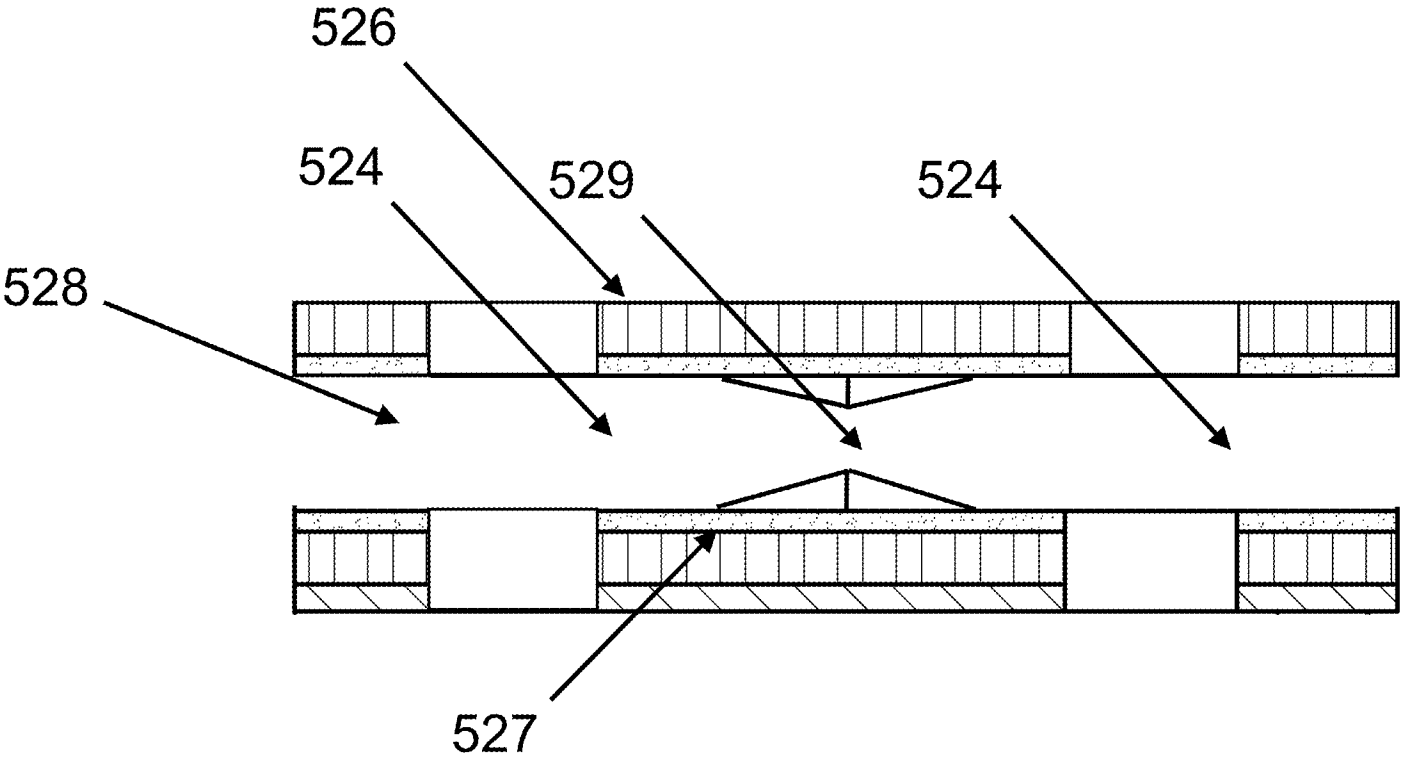
FIG. 22 illustrates a broken view of another embodiment of the device.

Sheath 520 may have an outer surface 526 and inner surface 527 defining an inner cavity as illustrated in FIG. 22. Outer surface 526 may be of any shape or texture. Inner surface 527 may be made of suitable elastomeric gel material. Inner cavity may have one or more individual compartments 524 may act as receiving elements for an individual penis whereby the individual penises may enter into individual compartments 524 through aperture 528 in the bottom surface portion 521 and top surface portion 523. When individual compartments 524 end or merge, a convergence compartment 529 is created such that at least a portion of the user's penises will be in direct contact in the convergence compartment 529.

In some embodiments, there may be multiple partitions directed inward into the center bottom surface portion 521 and top surface portion 523. This is non-limiting and partitions may be positioned in any arrangement, pattern, or configuration. Sidewall portion 522 may have a threaded portion or ribbed portion along inner wall 527 allowing for further pleasuring of the penises inside of individual compartments 524.

Figure 23:
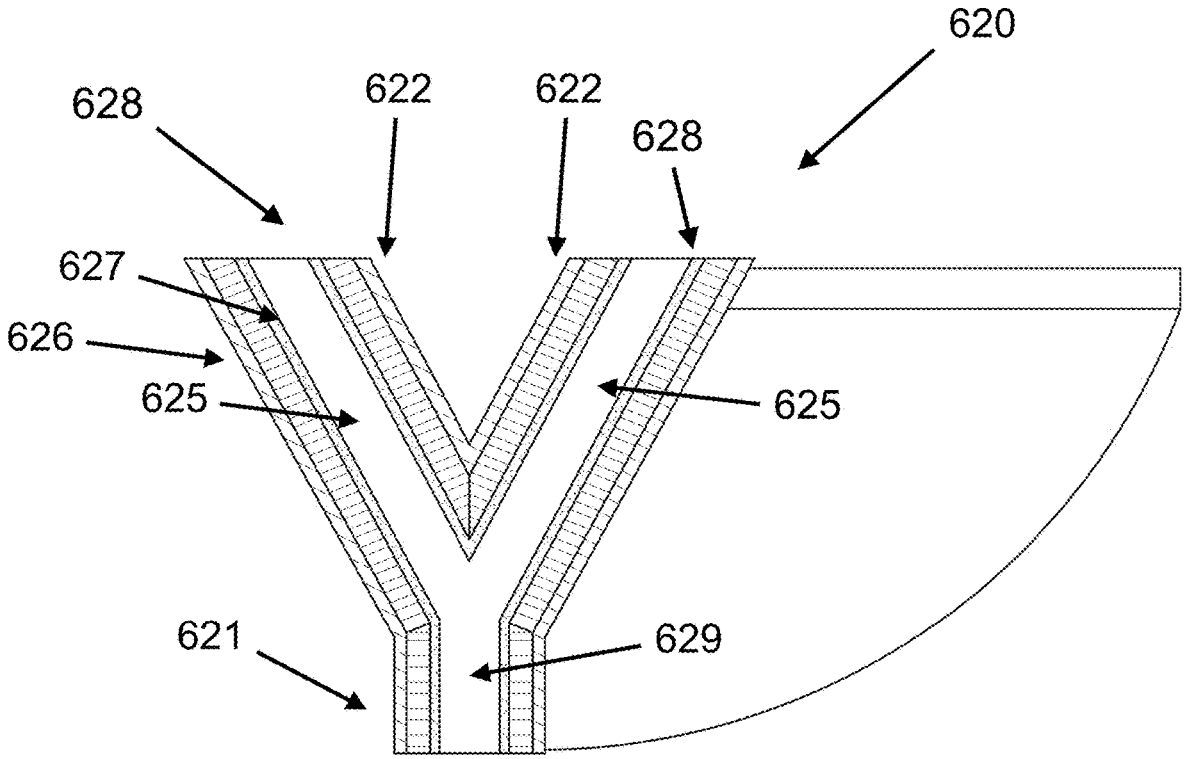
FIG. 23 illustrates a broken view of another embodiment of the device.

With reference now to FIG. 23, another embodiment of sheath 620 is generally shown. Sheath 620 may have a y-shaped body with a bottom portion 621 with an aperture therethrough the center of bottom surface portion 621. Two top portions 622 extends upward at an angle from an upper margin of bottom portion 621 whereby the two top portions are symmetrical to one another. Two top portions 622 having an aperture 628 therethrough.

Sheath 620 may have an outer surface 626 and inner surface 627 defining an inner cavity. Outer surface 626 may be of any shape or texture. Inner surface 627 may be made of suitable elastomeric gel material. The inner cavity may have one or more individual compartments 625 may act as receiving elements for an individual penis whereby the individual penises may enter into individual compartments 625 through apertures in top portions 622. When individual compartments 625 end or merge, a convergence compartment 629 in bottom portion 621 is created such that at least a portion of the user's penises will be in direct contact in the convergence compartment 629.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A sex toy, comprising: an elongated hollow tube body having a cylinder shape with a first base at a first end and a second base at a second end opposite of the first end with a curved surface extending between the first end and the second end wherein the first base has a first opening configured to receive a first and second user's genitals, wherein the second base is closed wherein the elongated hollow tube body has an inner surface of an elastomeric gel material and a more rigid outer surface;

a ring attached to the first end of the elongated hollow tube body;

a waistband attached to the elongated hollow tube body near the second end; and straps, wherein the straps have a first end attached to the elongated hollow tube body, wherein the straps have an opposite end attached to the waistband.

2. The sex toy of claim 1, wherein the first opening is divided by one or more partitions directed inward forming a first compartment and a second compartment, wherein the elongated hollow tube body is configured to receive a first user's genitals in the first compartment and a second user's genitals in the second compartment wherein the first user's genitals and the second user's genitals converge together at a length into the elongated hollow tube body.

3. A sex toy, comprising: an elongated hollow tube body that is a cylinder with a first base at a first end and a second base at a second end with a curved surface extending between the first end and the second end, wherein the curved surface spans an entire length of the elongated hollow tube body, wherein the first base has a first opening through the first base configured to receive a first and second user's genitals, wherein the second base has a second opening through the second base wherein the elongated hollow tube body has an inner surface of an elastomeric gel material and a more rigid outer surface;

a ring attached to the first end of the elongated hollow tube body;

a waistband attached to the elongated hollow tube body near the second end; and straps, wherein the straps have a first end attached to the elongated hollow tube body, wherein the straps have an opposite end attached to the waistband, wherein the first opening is divided by one or more partitions directed inward forming a first compartment and a second compartment, wherein the elongated hollow tube body is configured to receive a first user's genitals in the first compartment and a second user's genitals in the second compartment where the first user's genitals and the second user's genitals converge together at a length into the elongated hollow tube body.

* * * * *